US009409404B2

(12) United States Patent
Fukuda et al.

(10) Patent No.: US 9,409,404 B2
(45) Date of Patent: Aug. 9, 2016

(54) LIQUID EJECTION HEAD AND LIQUID EJECTION APPARATUS

(71) Applicant: CANON FINETECH INC., Saitama (JP)

(72) Inventors: Yoshihito Fukuda, Misato (JP); Kenro Yamaguchi, Noda (JP); Takashi Sugai, Noda (JP); Noritaka Ota, Kashiwa (JP); Kayo Mukai, Tokyo (JP); Masayoshi Yazaki, Noda (JP)

(73) Assignee: Canon Finetech, Inc., Misato-shi (JP)

( * ) Notice: Subject to any disclaimer, the term of this patent is extended or adjusted under 35 U.S.C. 154(b) by 0 days.

(21) Appl. No.: 14/221,749

(22) Filed: Mar. 21, 2014

(65) Prior Publication Data

US 2014/0285586 A1 Sep. 25, 2014

(30) Foreign Application Priority Data

Mar. 22, 2013 (JP) ..... 2013-060517
Jan. 15, 2014 (JP) ..... 2014-005229

(51) Int. Cl.
*B41J 2/175* (2006.01)
*B41J 2/19* (2006.01)
*B41J 2/14* (2006.01)

(52) U.S. Cl.
CPC .. *B41J 2/175* (2013.01); *B41J 2/14* (2013.01); *B41J 2/19* (2013.01); *B41J 2002/14403* (2013.01)

(58) Field of Classification Search
USPC ..... 347/7, 19, 84, 85, 92
See application file for complete search history.

(56) References Cited

U.S. PATENT DOCUMENTS

| | | | | |
|---|---|---|---|---|
| 6,505,923 | B1 * | 1/2003 | Yamamoto et al. | 347/85 |
| 6,520,630 | B1 * | 2/2003 | Oda et al. | 347/85 |
| 6,726,313 | B1 * | 4/2004 | Oda et al. | 347/85 |
| 6,799,841 | B2 | 10/2004 | Iri et al. | |
| 6,976,753 | B2 | 12/2005 | Kuwabara et al. | |
| 7,185,977 | B2 * | 3/2007 | Kyogoku et al. | 347/86 |
| 7,380,921 | B2 | 6/2008 | Nanjo et al. | |
| 7,434,916 | B2 | 10/2008 | Mukai et al. | |
| 7,537,318 | B2 | 5/2009 | Fujii et al. | |
| 8,020,983 | B2 * | 9/2011 | Nishimori | 347/92 |

(Continued)

FOREIGN PATENT DOCUMENTS

| | | |
|---|---|---|
| JP | 08-336985 A | 12/1996 |
| JP | 2001-187459 A | 7/2001 |

(Continued)

OTHER PUBLICATIONS

Search Report in European Patent Application No. 14160834.9, dated May 26, 2014.

(Continued)

*Primary Examiner* — Anh T. N. Vo
(74) *Attorney, Agent, or Firm* — Fitzpatrick, Cella, Harper & Scinto

(57) ABSTRACT

A liquid ejection head is capable of ejecting a liquid through an ejection port, the liquid being supplied from a liquid container with a negative pressure generating section. The liquid ejection head comprises a liquid chamber configured to contain the liquid, a liquid supply section configured to allow the liquid to be supplied from the liquid container to the liquid chamber, and an opening configured to communicate with the liquid chamber and to enable the liquid and/or a gas to flow into the liquid chamber through the opening.

26 Claims, 13 Drawing Sheets

(56) References Cited

U.S. PATENT DOCUMENTS

| | | | | |
|---|---|---|---|---|
| 8,348,365 | B2 * | 1/2013 | Huang et al. | 347/7 |
| 2005/0157041 | A1 | 7/2005 | Inoue | |
| 2011/0316907 | A1 | 12/2011 | Huang et al. | |
| 2012/0098898 | A1 | 4/2012 | Park et al. | |
| 2013/0208044 | A1 | 8/2013 | Matsumoto et al. | |
| 2013/0286116 | A1 | 10/2013 | Takahashi et al. | |
| 2014/0285586 | A1 | 9/2014 | Fukuda et al. | |

FOREIGN PATENT DOCUMENTS

| | | | |
|---|---|---|---|
| JP | 2003-039705 | A | 2/2003 |
| JP | 2003-080714 | A | 3/2003 |
| JP | 2004-122500 | A | 4/2004 |
| JP | 2004-188720 | A | 7/2004 |
| JP | 2005-103858 | A | 4/2005 |
| JP | 2005-231351 | A | 9/2005 |
| JP | 2005-279962 | A | 10/2005 |
| JP | 2009-040062 | A | 2/2009 |
| JP | 2009-220059 | A | 10/2009 |
| JP | 2010-274607 | A | 12/2010 |
| JP | 2011-000823 | A | 1/2011 |
| JP | 2011-201149 | A | 10/2011 |
| JP | 2011-235605 | A | 11/2011 |
| JP | 2013-129163 | A | 7/2013 |
| JP | 2015-127491 | A | 9/2015 |
| JP | 6806341 | B2 | 11/2015 |

OTHER PUBLICATIONS

Office Action in Japanese Patent Application No. 2014-005229, dated Feb. 17, 2015.

Office Action in Japanese Patent Application No. 2014-058462, dated Aug. 18, 2015.

Office Action in Japanese Patent Application No. 2015-173722, dated Apr. 26, 2016.

* cited by examiner

LIQUID EJECTION HEAD AND LIQUID EJECTION APPARATUS

BACKGROUND OF THE INVENTION

1. Field of the Invention

The present invention relates to a liquid ejection head and a liquid ejection apparatus which are widely applicable, for example, as an ink jet print head that enables ink to be ejected and an ink jet printing apparatus including the ink jet print head.

2. Description of the Related Art

A liquid ejection head of this type generally includes liquid channels extending from an upstream side in a direction in which a liquid is fed toward ejection ports. Each of the liquid channels provides an ejection energy generating element such as an electrothermal converter (heater) or piezo element. When the liquid channel provides an electrothermal converter, heat generated by the electrothermal converter bubbles a liquid in the liquid channel, and the resulting bubbling energy can be utilized to eject the liquid through the ejection port.

Such a liquid ejection head is internally maintained at a constant negative pressure for ejecting liquid stably from the ejection port. Japanese Patent Laid-Open No. 2009-40062 describes a configuration in which a liquid is fed from a liquid tank, with a negative pressure applied to the liquid by a negative pressure generating section provided in an ink cartridge.

In the configuration described in Japanese Patent Laid-Open No. 2009-40062, the ink cartridge includes the negative pressure generating section, and the pressure (negative pressure) is applied to the inside of the liquid ejection head only by the negative pressure generating section. This precludes the pressure inside the liquid ejection head from being adjusted.

SUMMARY OF THE INVENTION

The present invention provides a liquid ejection head and a liquid ejection apparatus which allows the pressure inside a print head to be adjusted.

In the first aspect of the present invention, there is provided a liquid ejection head capable of ejecting a liquid through an ejection port, the liquid being supplied from a liquid container with a negative pressure generating section, the liquid ejection head comprising:

a liquid chamber configured to contain the liquid;

a liquid supply section configured to allow the liquid to be supplied from the liquid container to the liquid chamber; and an opening configured to communicate with the liquid chamber and to enable the liquid and/or a gas to flow into the liquid chamber through the opening.

In the second aspect of the present invention, there is provided a liquid ejection apparatus configured to use a liquid ejection head configured to enable a liquid to be ejected to apply the liquid ejected from the ejection head to a print medium, wherein the liquid ejection head according to the first aspect of the present invention is used as the liquid ejection head, and the apparatus comprises a transfer section configured to transfer the liquid or a gas to the opening in the liquid ejection head which communicates with the liquid chamber.

The present invention includes, besides the liquid supply section feeding the liquid into the liquid ejection head, the opening enabling the liquid and/or gas inside the liquid chamber to flow out through the opening. This allows the pressure inside the liquid ejection head to be adjusted.

Further features of the present invention will become apparent from the following description of exemplary embodiments (with reference to the attached drawings).

DESCRIPTION OF THE EMBODIMENTS

An embodiment of the present invention will be described below with reference to the drawings.

Figure 1A:
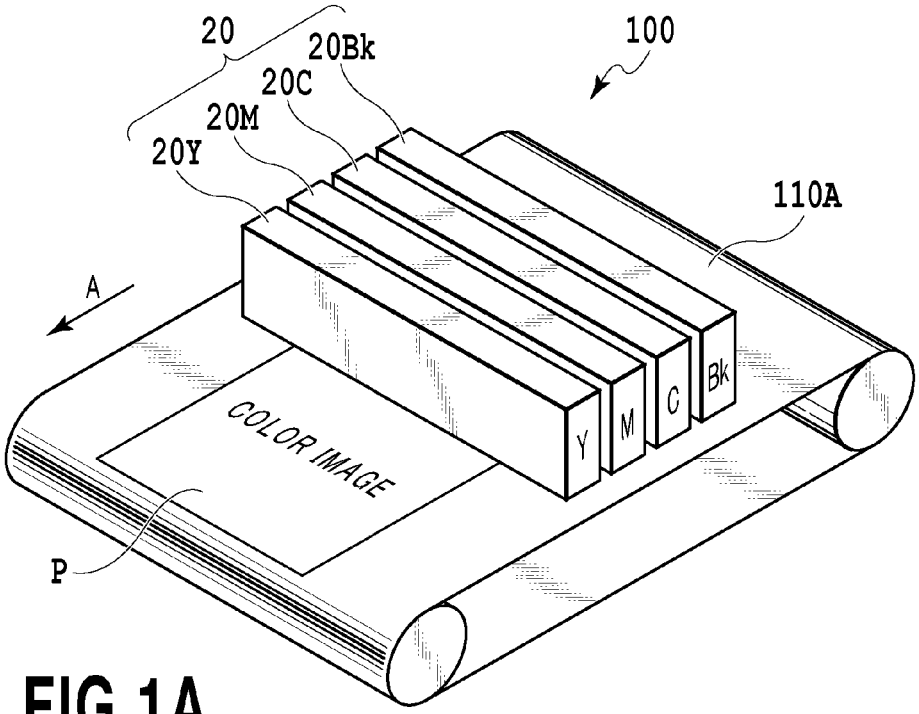
FIG. 1A is a schematic diagram of a configuration of a printing apparatus including a print head serving as a liquid ejection head according to a first embodiment of the present invention.
Figure 1B:
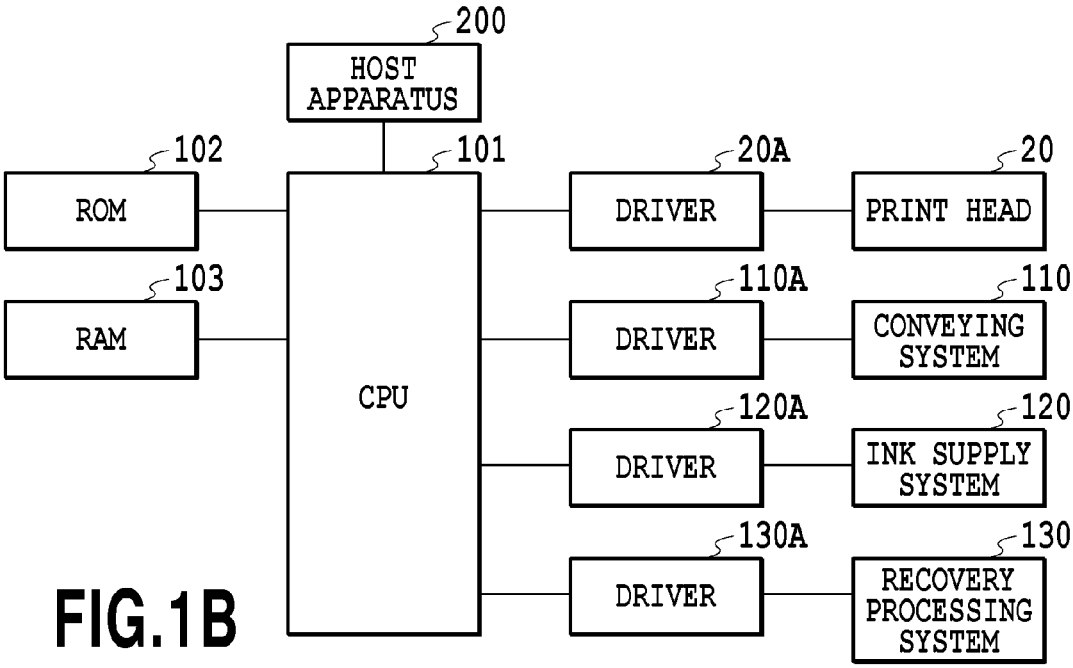
FIG. 1B is a block diagram of a control system for the printing apparatus in FIG. 1A.

FIG. 1A is a perspective view of an important part of an ink jet printing apparatus (liquid ejection apparatus) 100 to which the present invention can be applied. FIG. 1B is a block diagram of a control system for the printing apparatus 100. The printing apparatus 100 includes an ink jet print head 20 provided in a replaceable manner and configured to eject ink (liquid), as an embodiment of a liquid ejection head according to the present invention.

The printing apparatus 100 in the present example is what is called a full-line printing apparatus. The printing apparatus 100 can print an image on a print medium P by ejecting ink from the print head 20 while a conveying system (conveying mechanism) 110 is continuously conveying the print medium P in a direction of arrow A. The conveying system 110 in the present example conveys the print medium P using a conveying belt 110A. However, the configuration of the conveying system 110 is not limited, and a conveying roller or the like may be used to convey the print medium P. Furthermore, in the present example, the print head 20 includes print heads 20Y, 20M, 20C, and 20Bk that eject a yellow (Y) ink, a magenta (M) ink, a cyan (C) ink, and a black (Bk) ink, respectively, which are all supplied by an ink supply system (ink supply mechanism) 120 described below. This allows color images to be printed.

The printing apparatus 100 includes a recovery operation system 130 used for a recovery operation for keeping an ink ejection state of the print head 20 appropriate. The recovery operation may include a preliminary ejecting operation of ejecting ink making no contribution to image printing into a cap through ejection ports and a pressure-based recovery operation of pressurizing ink in the print head and forcibly discharging the pressurized ink into the cap through the ejection ports. The recovery operation may further include a suction-based recovery operation of sucking and discharging ink into the cap through the ejection ports and a wiping operation of wiping an ejection port surface of the print head in which the ejection ports are formed.

A CPU (control section) 101 in the printing apparatus 100 carries out processing for controlling operations of the printing apparatus, data processing, and the like. Programs for procedures for the above-described processing and the like are stored in ROM 102. RAM 103 is used, for example, as a work area in which the processing is carried out. The CPU 101 controls the print head 20, the conveying system 110, the ink supply system 120, and the recovery operation system 130 via corresponding drivers 20A, 110A, 120A, and 130A. The CPU 101 allows an image to be printed on the print medium P by ejecting ink from the print head 20 based on image data input via a host apparatus 200 such as a host computer. The CPU 101 operates the print head 20, the conveying system 110, the ink supply system 120, and the recovery operation system 130 to perform control "during cleaning of the print head", control "during stirring of ink", and control "at the start of ink supply".

Figure 2:
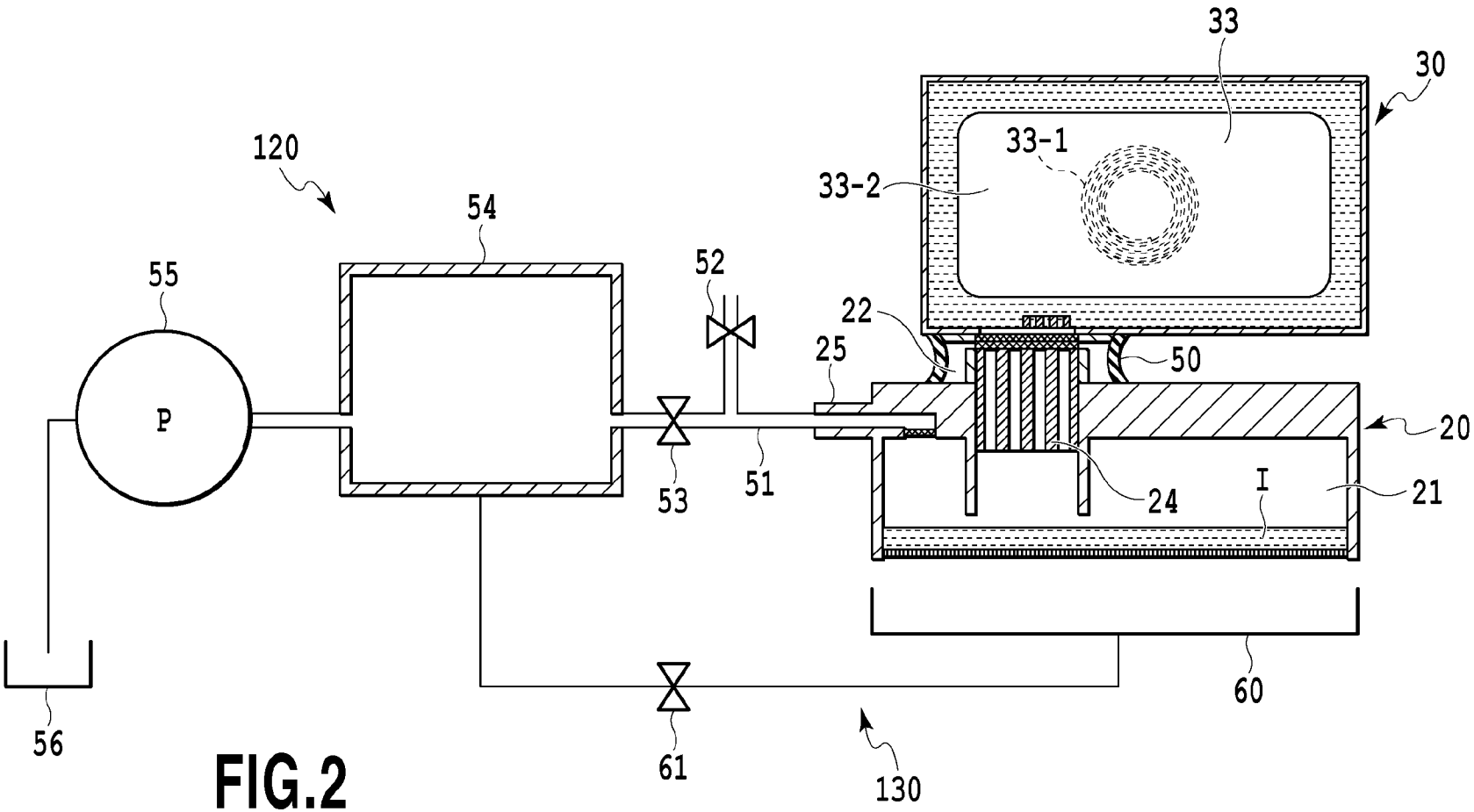
FIG. 2 is a schematic diagram of a configuration of an ink supply system in the printing apparatus in FIG. 1A.
Figure 3:
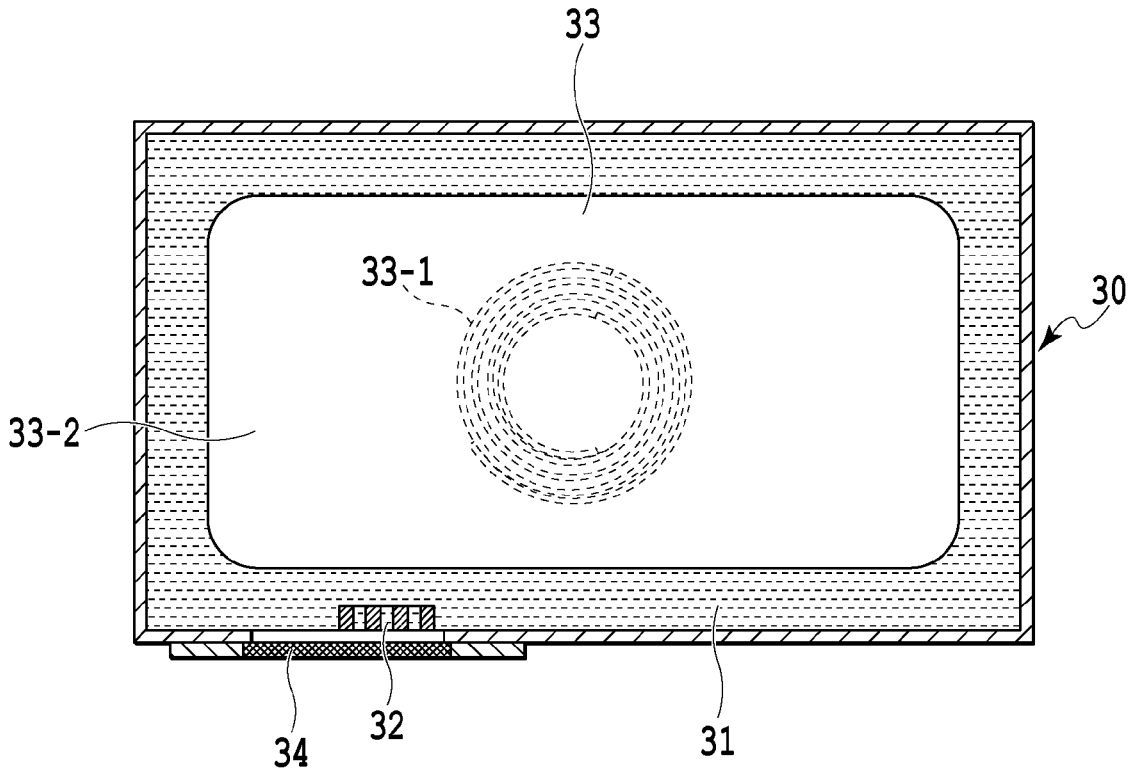
FIG. 3 is a cross-sectional view of an ink tank in FIG. 2.
Figure 4:
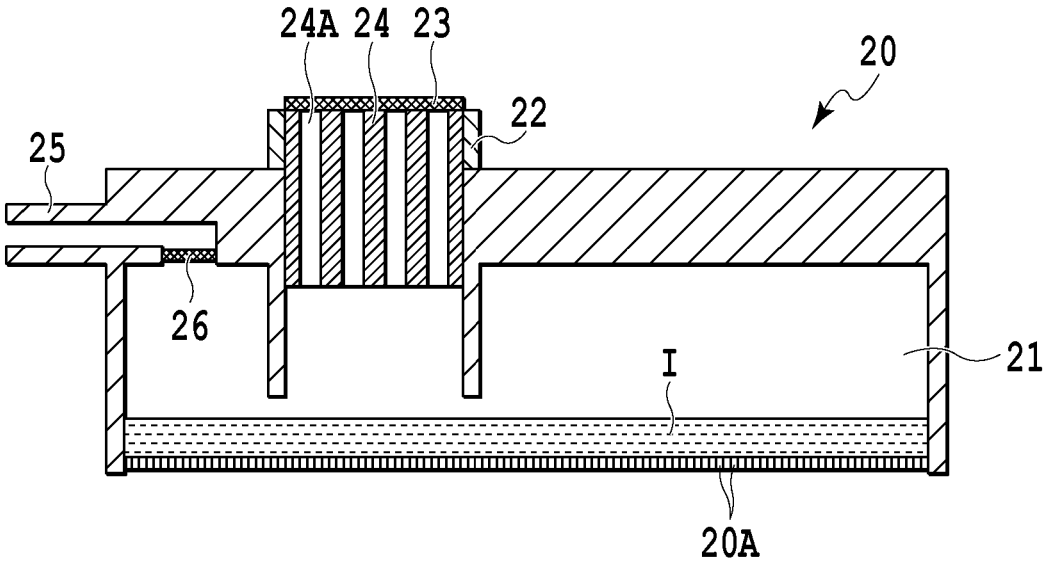
FIG. 4 is a cross-sectional view of the print head in FIG. 2.

FIG. 2 is a diagram illustrating the ink supply system 120 and the recovery operation system 130. FIG. 3 is an enlarged cross-sectional view of an ink tank 30 in FIG. 2. FIG. 4 is an enlarged cross-sectional view of the print head 20 in FIG. 2.

An ink chamber (liquid chamber) 31 in which ink is contained is formed inside the ink tank 30, which serves as a liquid container. The ink chamber 31 forms a closed space that can communicate with the outside only at a joint portion 32. The ink tank 30 is configured to be able to be installed in and removed from the print head 20. Furthermore, the ink tank 30 is provided above the print head 20. The ink chamber 31 is formed of a flexible member, and a pressure plate 33-2 connected to a spring 33-1 for negative pressure generation is incorporated in the ink chamber 31. The spring 33-1 biases the inside of the ink chamber 31 toward the outside so as to enlarge an internal space in the ink chamber 31 via the pressure plate 33-2. Thus, the spring 33-1 generates a predetermined negative pressure inside the ink chamber 31. The spring 33-1, the pressure plate 33-2, and the ink chamber 31 provide a negative pressure generating section. The joint portion 32 is provided with a filter 34 of a nonwoven cloth.

The print head 20 includes an ejection energy generating element (not shown in the drawings) for ejecting ink I in an ink chamber 21 (a liquid in the liquid chamber) through ejection ports 20A. The ejection energy generating element may be an electrothermal converter (heater), a piezo element, or the like. With an electrothermal converter, heat generated by the electrothermal converter bubble the ink, and the resulting bubbling energy can be utilized to eject the ink through the ejection port 20A. Air (gas), as well as the ink I, is preset in the ink chamber 21. Thus, the ink chamber 21 includes an ink containing section (liquid containing section) formed therein and containing the ink and an air containing section (gas containing section) also formed therein and containing air (gas).

Figure 5A:
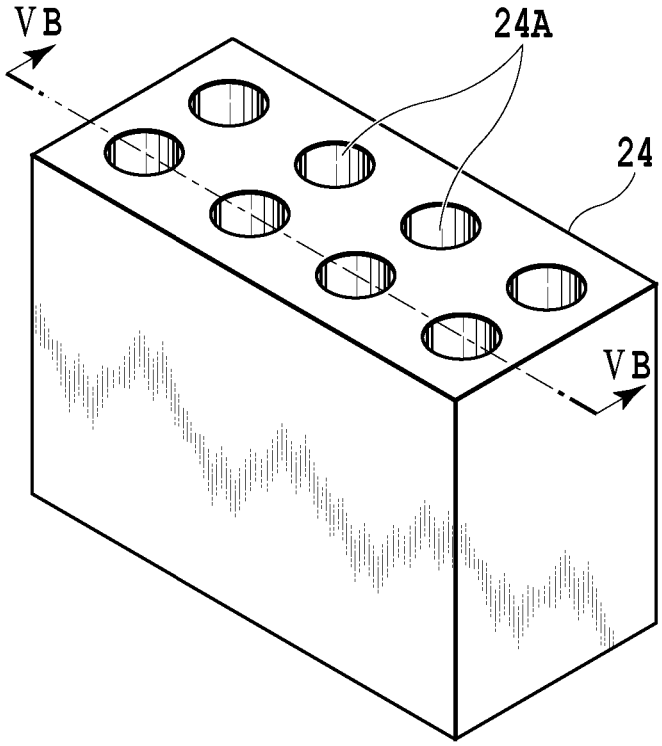
FIG. 5A is a perspective view of an ink holding member in FIG. 4.
Figure 5B:
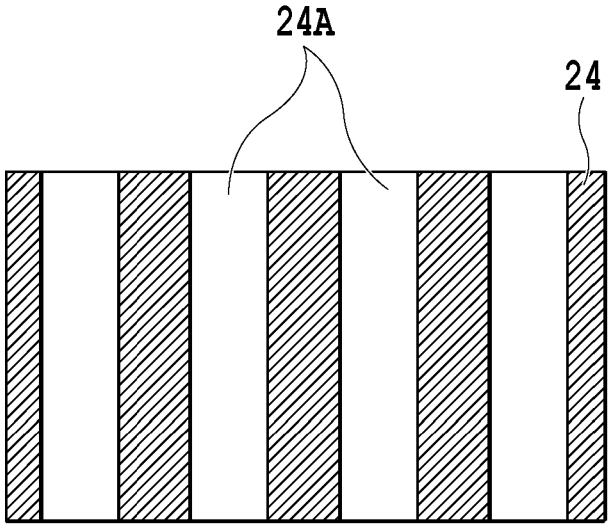
FIG. 5B is a cross-sectional view taken along line VB-VB in FIG. 5A.

An ink supply section (liquid supply section) 22 for communication with the ink tank (liquid tank) 30 is provided above the ink chamber 21. A filter member 23 is provided on an opening of the supply section 22. In the present example, the filter member 23 is formed of an SUS mesh. The mesh is configured by inweaving metal fiber, and the supply section 22 has an average width of about 10 mm. The filter member 23 is finely woven and thus prevents external dust and dirt from entering the print head. A bottom surface of the filter member 23 is pressed against an ink holding member (liquid holding member) 24 capable of holding the ink. As shown in FIG. 5A and FIG. 5B, a plurality of channels 24A each with a circular cross section is formed inside the ink holding member 24. Each of the channels 24A has a diameter of about 1.0 mm.

Furthermore, the ink chamber 21 includes an opening 25 provided in an upper portion of the ink chamber 21 and which can be connected to a transfer section 51 serving as an external channel to transfer the gas and/or liquid. The opening 25 is provided with a filter 26. The opening 25 is configured to enable the liquid (ink) or gas in the ink chamber 21 to flow out to the outside through the opening 25. The opening 25 also enables both the liquid (ink) and gas in the ink chamber 21 to flow out through the opening 25. Additionally, the opening 25 is configured to enable the liquid (ink) or gas outside the print head 20 to flow into the opening 25. Moreover, the opening 25 is configured to enable both the liquid (ink) and gas outside the print head 20 to flow into the opening 25.

The print head 20 and the ink tank 30 are coupled together as shown in FIG. 2. That is, the supply section 22 of the print head 20 and the joint portion 32 of the ink tank 30 are coupled together so the filter member 23 on the print head 20 side and the filter 34 on the ink tank 30 side are compressed against each other in the vertical direction. Such a coupled portion between the print head 20 and the ink tank 30 is kept closed by being circumferentially surrounded by an elastic cap member 50 formed of rubber. In the present example, the print head 20 and the ink tank 30 are directly connected together, and thus, an ink supply path (liquid supply path) between the print head 20 and the ink tank 30 is very short.

The transfer section 51 connected to the opening 25 of the print head 20 is divided into two branches. One of the branches is in communication with the outside air via an openable and closable valve 52. The other branch is in communication with a buffer chamber 54 via an openable and closable valve 53. A space of about 10 mL is formed in the buffer chamber 54 and is in communication with a waste ink tank 56 through a pump 55. The pump 55 is a transfer section which serves as means for transferring the liquid (ink) and/or gas (air) and which pumps the liquid (ink) and/or gas (air) into and out from the print head 20. In the present example, a tube pump capable of forward and reverse rotations is used as the pump 55.

A cap 60 is connected to the buffer chamber 54 via an openable and closable valve 61. The cap 60 can come into tight contact with a surface (ejection port formation surface) of the print head 20 in which the ejection ports 20A are formed. When the cap 60 is internally sucked using the pump 55 with the ejection ports 20A capped by the cap 55, the ink can be sucked and discharged into the cap 60 through the ejection ports 20A (suction-based recovery operation). Furthermore, the following are possible: a preliminary ejection operation of ejecting ink making no contribution to image printing into the cap 60 through the ejection ports 20A and a pressure-based recovery operation of pressurizing the ink in the print head 20 to forcibly discharge the ink into the cap 60 through the ejection ports 20A. During the pressuring recovery operation, a pressurizing force generated using the pump 55 can be exerted into the print head 20 through the buffer chamber 54 and the valve 53. The ink contained in the cap 60 as result of the recovery operation can be discharged into the waste ink tank 56 (see FIG. 2) by a suction force generated using the pump 55.

Now, description will be provided which relates to the state of the printing apparatus while the ink is stationary, during a printing operation, during cleaning of the print head, during stirring of the ink, and at the start of ink supply.

(While the Ink is Stationary)

Figure 6A:
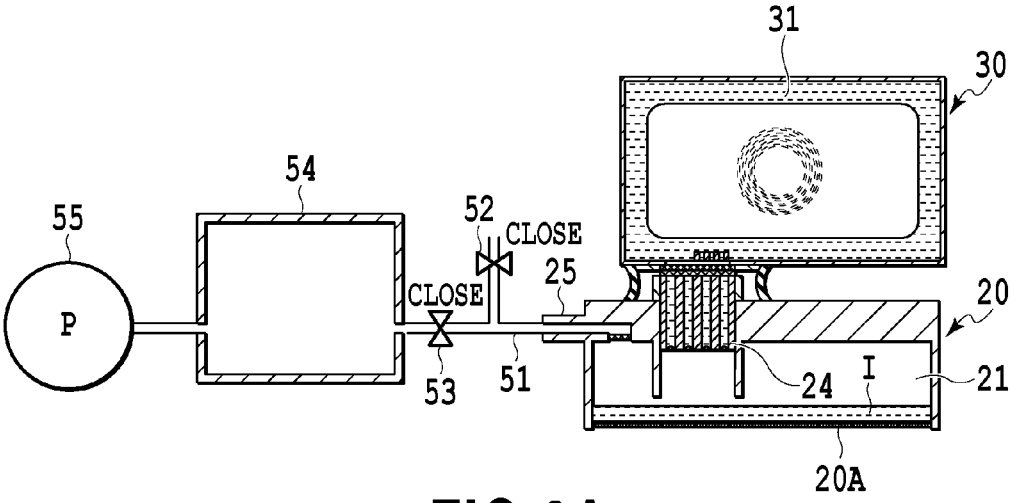
FIG. 6A is a diagram illustrating the state of the ink supply system observed when ink is stationary.
Figure 6B:
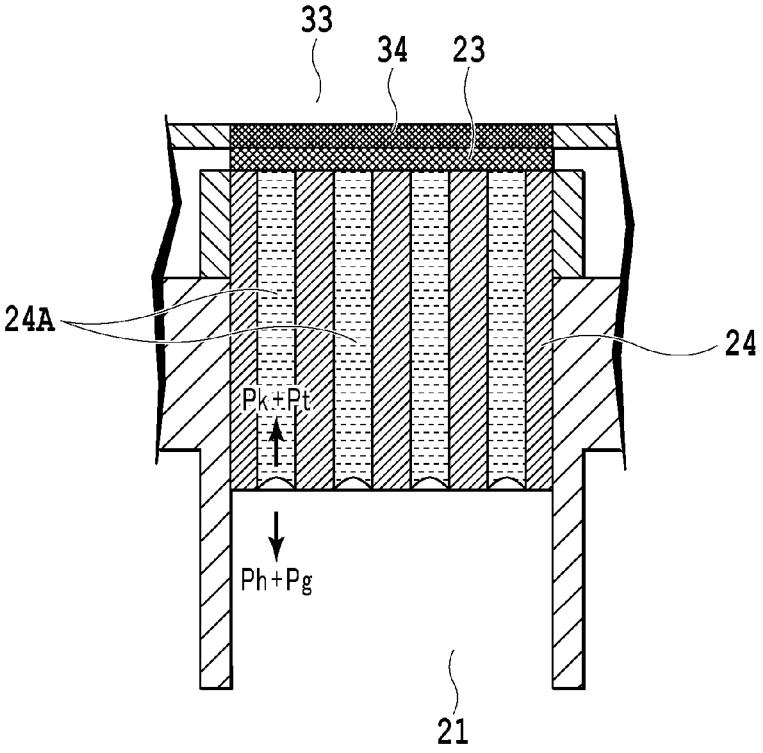
FIG. 6B is an enlarged cross-sectional view of the ink holding member in FIG. 6A.

While the ink is stationary, for example, while the printing apparatus is stopped, the valves 52 and 53 are closed as shown in FIG. 6A. Ink is filled in the channels 24A of the ink holding member 24. The ink chamber 21 in the print head 20 is internally at a predetermined negative pressure. Ink meniscuses formed in the ejection ports 20A are maintained. Ink meniscuses are formed in the channels 24A of the ink holding member 24 as shown in FIG. 6B. Forces Pt, Ph, Pk, and Pg act on the meniscuses in the channels 24A of the ink holding member 24. The force Pt results from the negative pressure in the ink tank 30 to draw in the meniscuses toward the ink tank side. The force Ph results from the negative pressure in the print head 20 to draw the meniscuses into the print head. The force Pk is a meniscus force resulting from the surface tension of the ink to draw in the ink toward the ink tank side. The force Pg results from the weight of the ink to move the ink downward. The forces are balanced to maintain the meniscuses formed in the ink holding member 24, keeping the ink in the print head 20 stationary.

(During a Printing Operation)

Figure 7A:
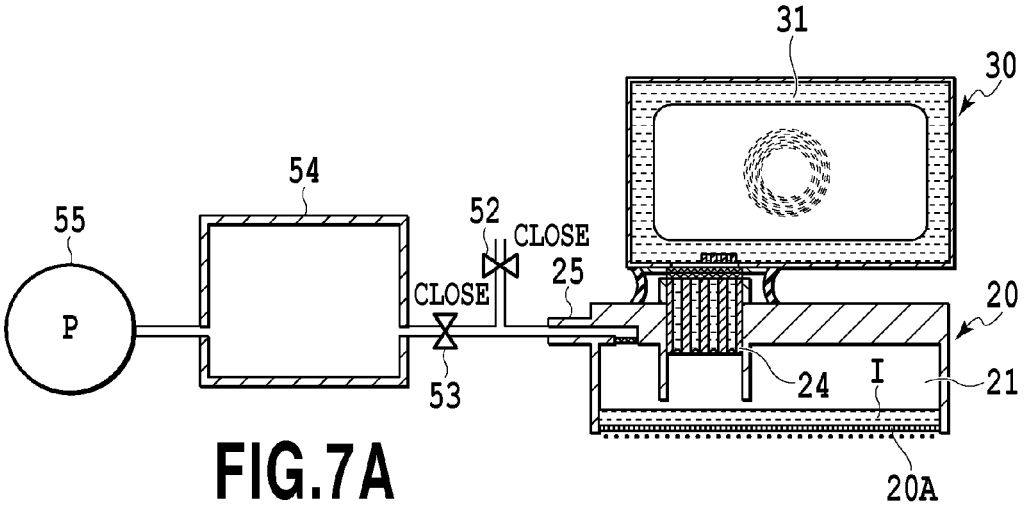
FIG. 7A, FIG. 7B, and FIG. 7C are each a diagram illustrating the state of the ink supply system during printing.
Figure 7B:
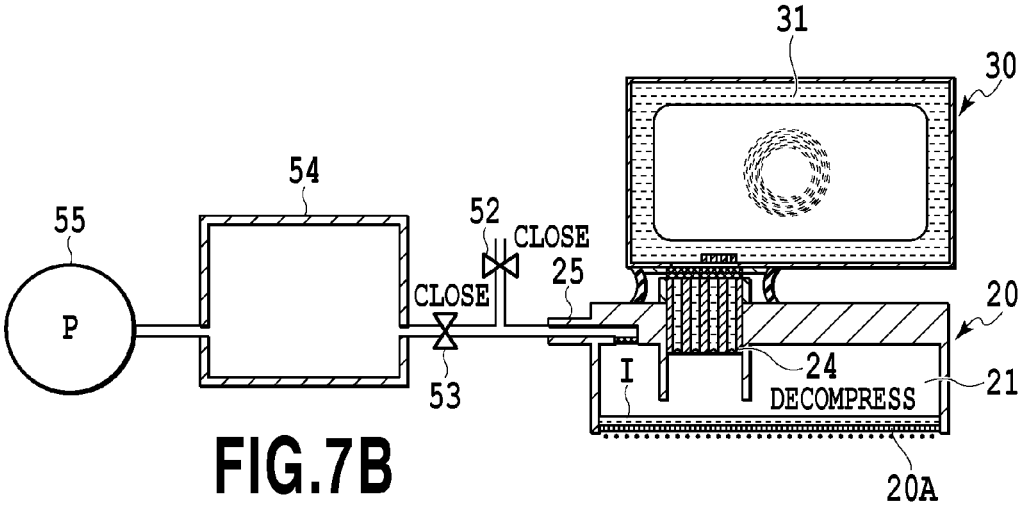
Figure 7C:
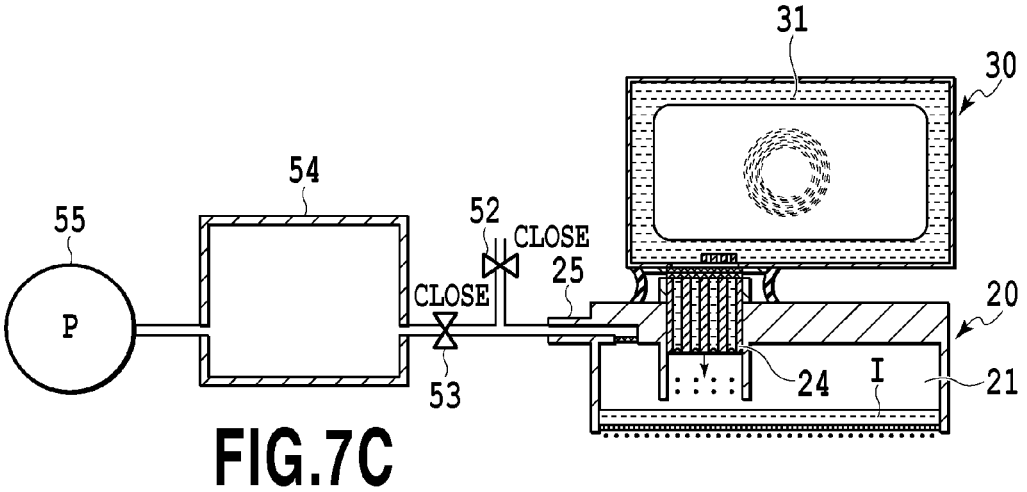

During a printing operation by the printing apparatus, the valves 52 and 53 are closed as shown in FIG. 7A, FIG. 7B, and FIG. 7C. When the ink is ejected through the ejection ports 20A as shown in FIG. 7A, the ink I in the ink chamber 21 is consumed to further reduce the pressure in the ink chamber 21 as shown in FIG. 7B. The thus increasing negative pressure in the ink chamber 21 acts as a force in a direction in which the ink in the channels 24A in the ink holding member 24 is drawn into the ink tank 30. When the negative pressure in the ink chamber 21 increases to a predetermined negative pressure or higher, the ink meniscuses formed in the channels 24A of the ink holding member 24 are broken to allow the ink in the ink tank 30 to be supplied to the print head 20 as shown in FIG. 7C. The supply of the ink reduces the negative pressure in the ink chamber 21 to form meniscuses again in the channels 24A of the ink holding member 24 as shown in FIG. 7A. The supply of the ink is then stopped. Thus, the ink is fed from the ink tank 30 into the ink chamber 21 in the print head 20 according to ink consumption.

The meniscus force Pk of the meniscus formed in each of the channels 24A of the ink holding member 24 acts as a force against the flow of the ink fed from the ink tank 30 to the print head 20. Thus, when the meniscus force Pk is excessively strong, the ink supply is hindered to degrade ink supply performance. The meniscus force P of the meniscus of the liquid formed in the opening of the liquid channel can be expressed by Formula 1 when the surface tension is denoted by γ, the radius of the opening is denoted by r, and the contact angle of the ink in the liquid channel is denoted by θ.

$$P = \frac{2\gamma\cos\theta}{r} \quad \text{(Formula 1)}$$

Furthermore, when the opening of the channel is not circular, the meniscus force P in the opening has a relation with a circumferential length L and an opening area S which is expressed by Formula 2 (the meniscus force P is proportional to L/S). Even if the opening is not truly circular, the theoretical formula in Formula 1 is applicable regardless of the shape of the opening when the opening is assumed to be a circular tube having an area as that of the opening and a radius r.

$$P \propto L/S \quad \text{(Formula 2)}$$

Thus, the meniscus force P decreases with increasing radius r of the opening of the liquid channel.

The plurality of channels 24A each with an inner diameter of about 1 mm is formed in the ink holding member 24 according to the present embodiment in a penetrating manner. The inner diameter of the channel 24A is set such that the meniscus force of the ink in the channel 24A is weaker than the meniscus force of the ink in the filter members 23 and 34. When the ink is supplied in association with a printing operation, no ink meniscus is formed in the filter members 23 and 24. This allows the ink supply performance to be improved so as to enable high-speed printing.

If the ink holding member 24 is not provided, meniscuses are formed in the filter member 23 or 34, degrading the ink supply performance. Specifically, the inner diameter of each of the ink channels formed in the filter members 23 and 34 is about one-thousandth of the inner diameter of the channel 24A of the ink holding member 24, and thus, the meniscus force in the ink channels in the filter members 23 and 34 is about 1,000 times as strong as the meniscus force in the channel 24A. Thus, without the ink holding member 24, the ink supply performance is significantly degraded.

(During Cleaning of the Print Head)

When the ejection port formation surface of the print head 20 is wiped and cleaned, the print head 20 is internally pressurized to push the ink I in the ink chamber 21 out through the ejection ports 20A to improve the lubricity of the ejection port formation surface.

Figure 8A:
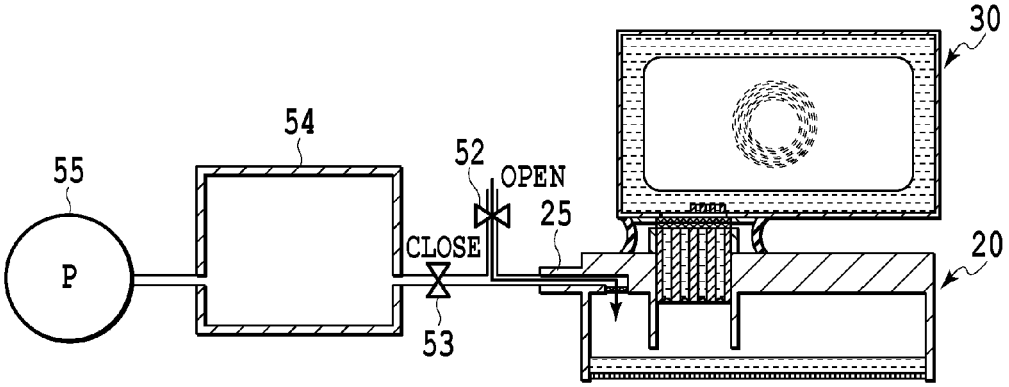
FIG. 8A, FIG. 8B, and FIG. 8C are each a diagram illustrating the state of the ink supply system during cleaning of the print head.
Figure 8B:
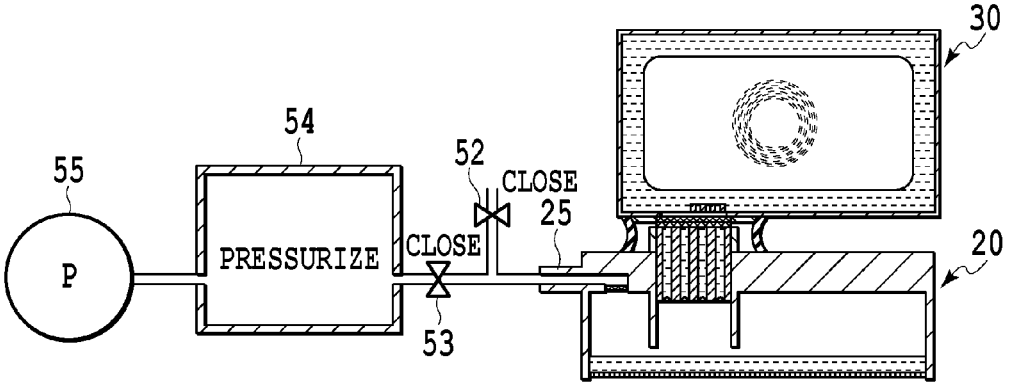
Figure 8C:
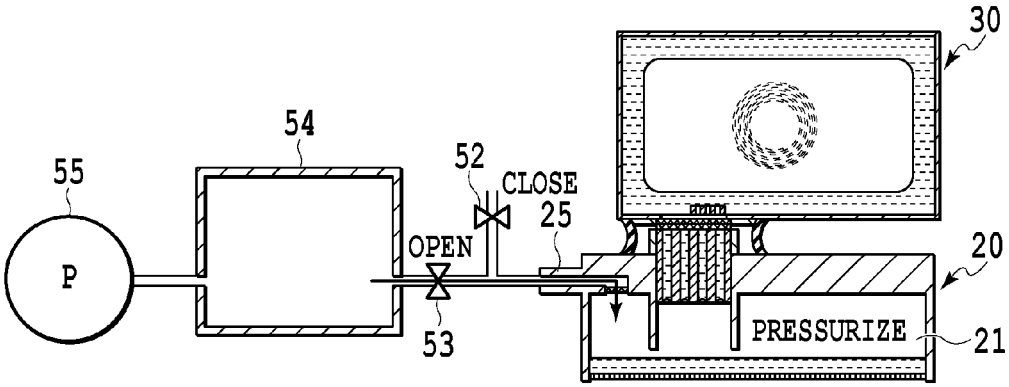

First, as shown in FIG. 8A, the valve 52 is opened to admit the outside air into the print head 20, thus releasing the negative pressure in the ink chamber 21. Then, as shown in FIG. 8B, the pump 55 is rotated in one direction with the valves 52 and 53 closed to feed air into the buffer chamber 54, thus pressurizing the buffer chamber 54. Then, as shown in FIG. 8C, the valve 53 is opened to admit the pressurized air in the buffer chamber 54 into the print head 20, thus pressuring the inside of the ink chamber 21. At this time, if, for example, the liquid (ink) is mixed in the buffer chamber 54 or the transfer section 51, the liquid (ink) and/or gas (air) flows into the print head 20.

Figure 9A:
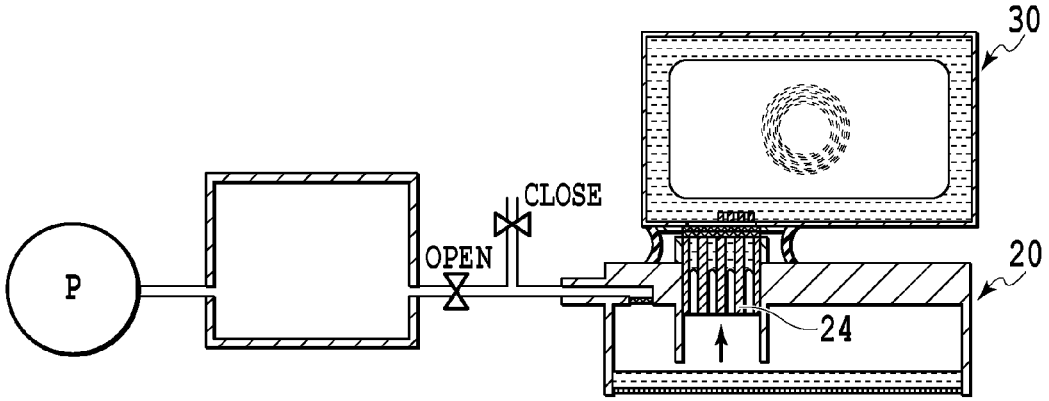
FIG. 9A, FIG. 9B, and FIG. 9C are each a diagram illustrating the state of the ink supply system during cleaning of the print head.
Figure 9B:
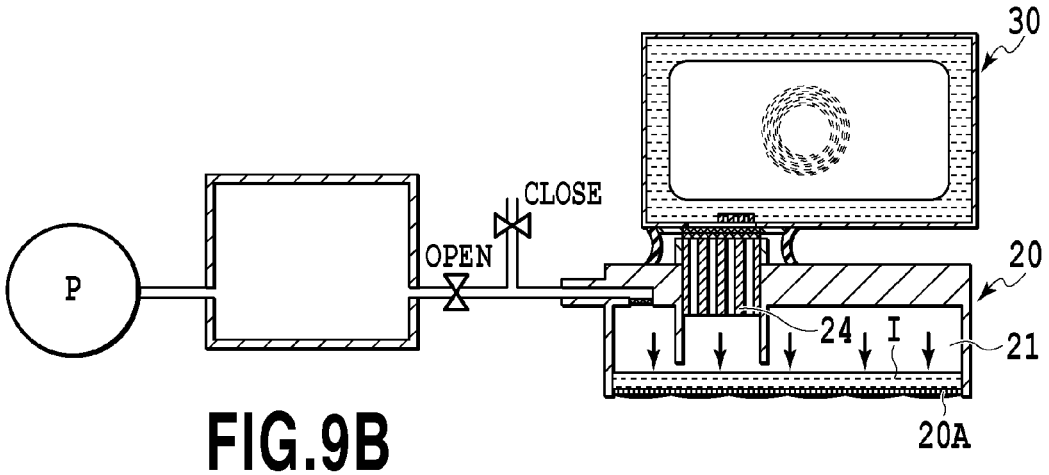

The internal pressurization of the ink chamber 21 moves the ink in the channels 24A of the ink holding member 24 and the ink in the ink chamber 21 as shown in FIG. 9A and FIG. 9B.

A relation shown below is set for the inner diameter Df of each ink channel formed in the filter member 23 on the print head side, the inner diameter Dk of each channel 24A in the ink holding member 24, and the inner diameter Dn of each ejection port 20A.

$$Df < Dn < Dk$$

Thus, a relation shown below is set for the meniscus force Pf in the filter member 23 on the print head side, the meniscus force Pk in the channel 24A of the ink holding member 24, and the meniscus force Pn in the ejection port 20A.

$$Pf>Pn>Pk$$

Figure 10A:
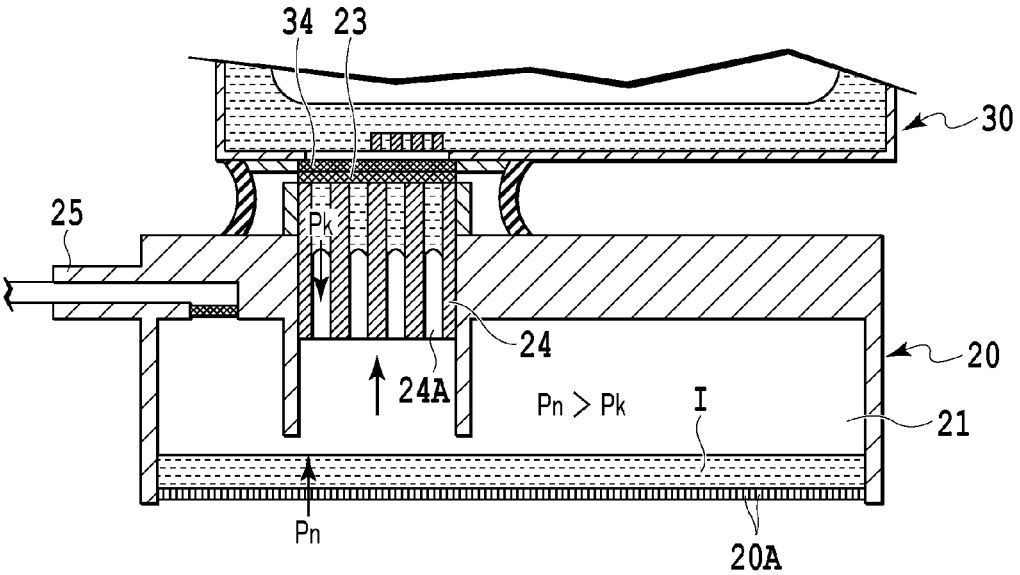
FIG. 10A, and FIG. 10B are each a diagram illustrating the state of the ink supply system during cleaning of the print head.
Figure 10B:
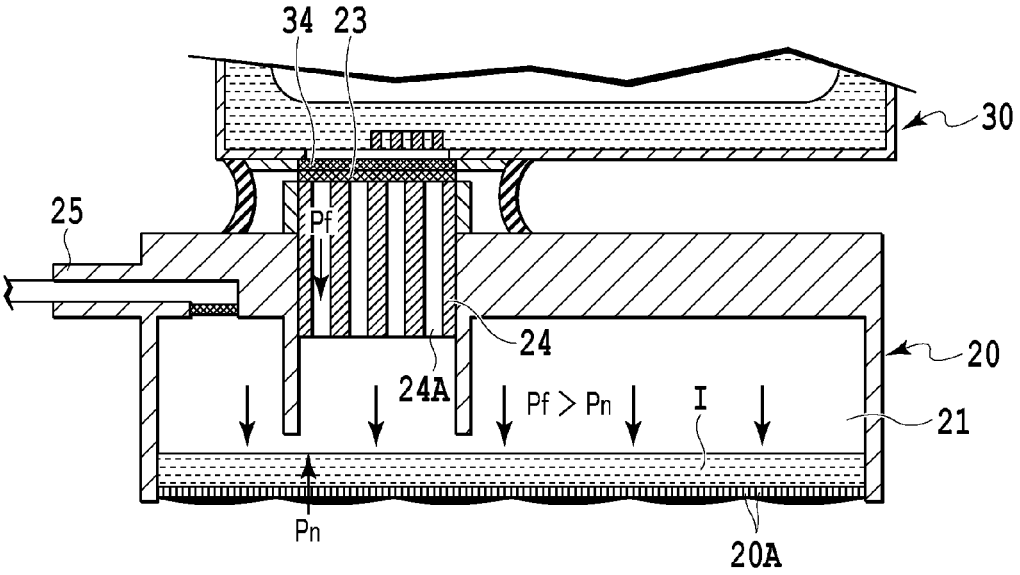

If the ink chamber 21 is internally pressurized, then as shown in FIG. 9A, the meniscuses in the channels 24A of the ink holding member 24 move backward, that is, upward in FIG. 9A. The meniscuses reach the filter member 23, and then, the ink is pushed out through the ejection ports 20A as shown in FIG. 9B. More specifically, first, the meniscuses in the ink holding member 24, which exert the weak meniscus force Pk, move backward to allow the ink in the channels 24A to flow backward into the ink tank 30 as shown in FIG. 10A. As shown in FIG. 10B, all of the ink in the channels 24A is returned into the ink tank 30 to form meniscuses in the filter member 23. The meniscus force Pn in the ejection ports 20A is weaker than the meniscus force Pf in the filter member 23, and thus, the ink in the ink chamber 21 is pushed out through the ejection ports 20A as shown in FIG. 10B.

The ink chamber 21 is internally pressurized to a pressure Pc. When the pressure Pc is higher than the meniscus force Pk, the meniscuses in the ink holding member 24 are moved toward the ink tank 30 side, and the ink is pushed out through the ejection ports 20A without moving the meniscuses in the filter member 23, which have the meniscus force Pf. Thus, the ink can be pushed out through the ejection ports 20A without moving the meniscuses in the filter member 23, in other words, without pushing the air in the print head into the ink tank.

Figure 9C:
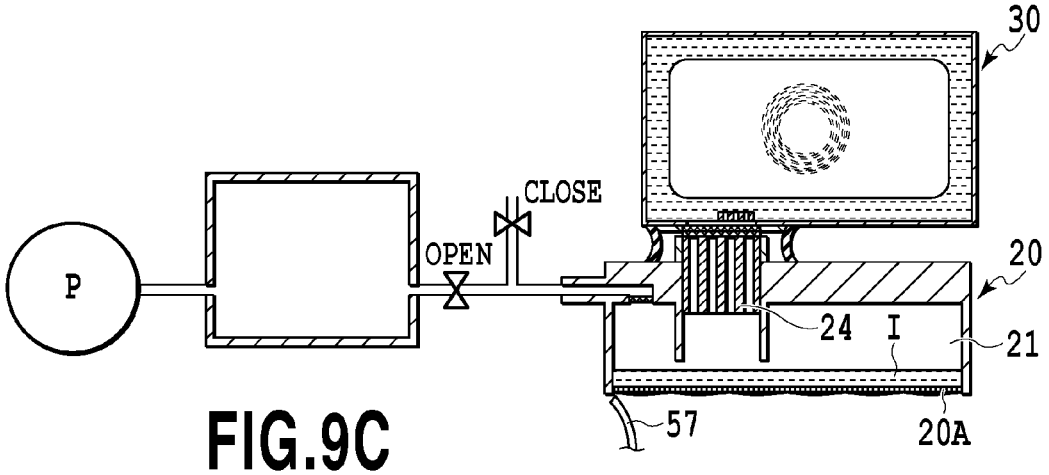

After the ejection port formation surface is sufficiently wetted with the ink pushed out as described above or while the ink is being pushed out through the ejection ports 20A, the ejection port formation surface is wiped by a plate-like cleaning member 57 as shown in FIG. 9C. This allows the capability of cleaning the ejection port formation surface to be improved. The cleaning member 57 is, for example, formed of urethane rubber and moves in a lateral direction in FIG. 9C while keeping in contact with the ejection port formation surface. Such movement may involve movement of at least either the cleaning member 57 or the print head 20.

After the wiping operation by the cleaning member 57, the pump 55 is reversely rotated to introduce a negative pressure into the print head 20. Thus, the liquid (ink) and/or gas (air) flows out from the print head 20, enabling such a state as shown in FIG. 6A and FIG. 6B to be recovered.

(During Stirring of Ink)

When the ink tank 30 is left untouched for a long period of time, the components of the ink inside the ink tank 30 may become nonuniform. In particular, if the ink in the ink tank 30 is pigment ink, a color material precipitates in a lower portion of the ink tank 30, leading to the risk of changing the density of a printed image. According to the present embodiment, the ink in the channels 24A of the ink holding member 24 is drawn into and out from the ink tank 30 in order to make the components of the ink in the ink tank 30 uniform.

Figure 11A:
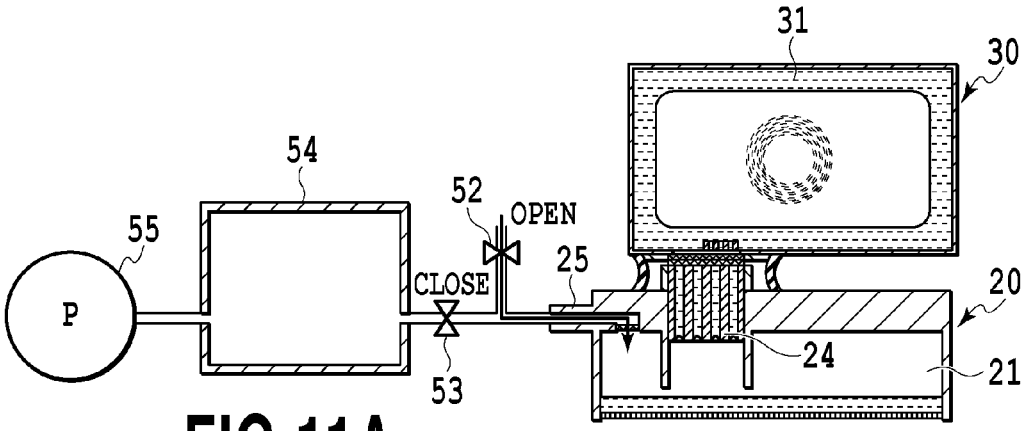
FIG. 11A, FIG. 11B, and FIG. 11C are each a diagram illustrating the state of the ink supply system during stirring of ink.
Figure 11B:
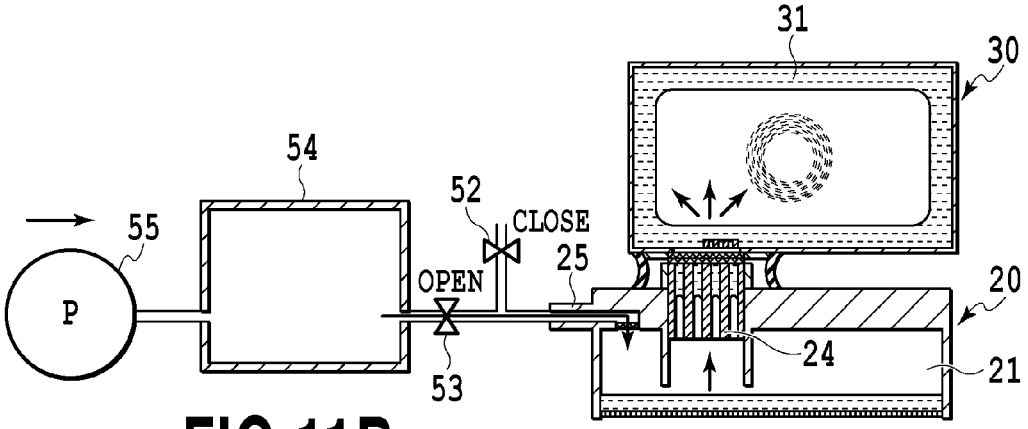

First, as shown in FIG. 11A, the valve 52 is opened to open the ink chamber 21 in the print head 20 to the atmosphere. Then, as shown in FIG. 11B, the valve 52 is closed and the valve 53 is opened, and then, the pump 55 is rotated in one direction to pressurize the inside of the ink chamber 21. The ink chamber 21 is pressurized up to a pressure Ps. The pressure Ps has a magnitude sufficient to move the meniscuses in the ink holding member 24, which have the meniscus force Pk, without pushing the ink out through the ejection ports 20A or moving the meniscuses in the filter member 23, which have the meniscus force Pf. Such a pressure Ps returns the ink in the channels 24A of the ink holding member 24 to the ink tank 30 as shown in FIG. 11B. The returned ink disturbs the ink components precipitated in a lower layer in the ink tank 30. As a result, the ink in the ink tank 301 can be stirred.

Figure 11C:
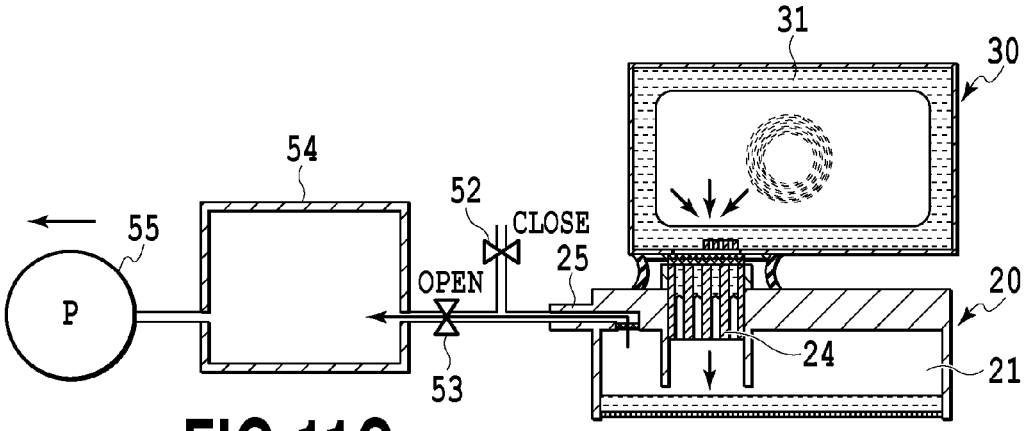

Thereafter, the pump 55 is reversely rotated to reduce the pressure in the print head 20, thus drawing the ink in the ink tank 30 into the channels 24A of the ink holding member 24 again, as shown in FIG. 11C. Thus, the ink positioned in an upper layer in the ink tank 30 can be drawn downward to stir the ink in the ink tank 30.

Such pressurization and pressure reduction in the print head 20 are repeated to draw the ink in the channels 24A of the ink holding member 24 into and out from the ink tank 30 a desired number of times. Then, the ink in the ink tank 30 can be sufficiently stirred to make the ink components uniform.

Furthermore, ink may be fed from the ink tank 30 into the ink chamber 21 until the level of the ink I in the ink chamber 21 becomes higher than a bottom surface of the ink holding member 24. Then, the ink I in the ink chamber 21 may be fed back to the ink tank 30 through the channels 24A of the ink holding member 24. This enables an increase in the amount of ink fed into and from the ink tank 30 to allow the ink in the ink tank to be effectively stirred. A specific example of such an ink stirring operation will be described using FIG. 12A, FIG. 12B, FIG. 13A, and FIG. 13B.

Figure 12A:
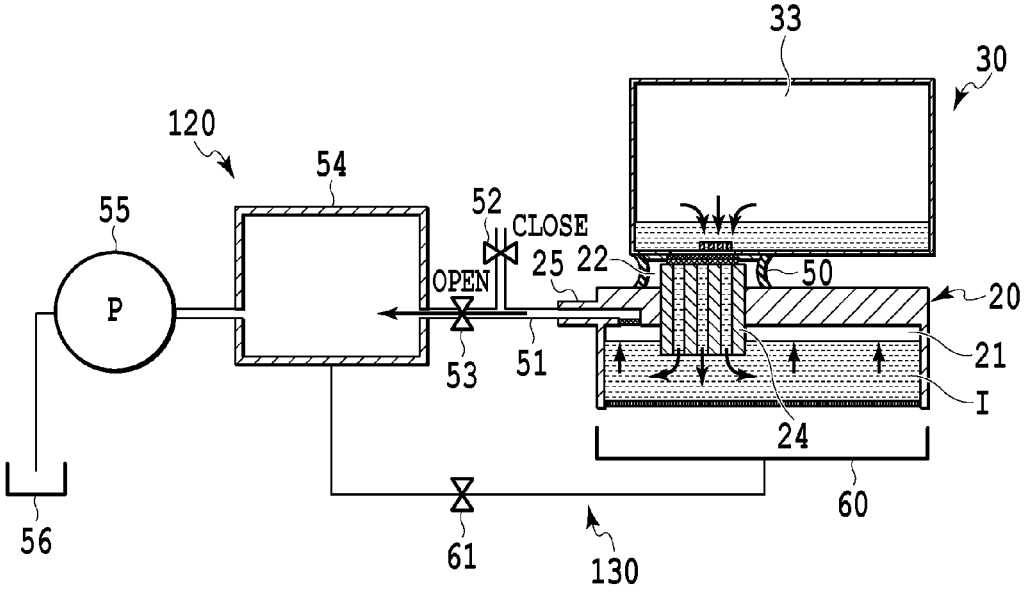
FIG. 12A and FIG. 12B are each a diagram illustrating a part of another example of the ink stirring operation.

First, as shown in FIG. 12A, the pump 55 is reversely rotated with the valve 52 closed and the valve 53 open to discharge the gas in the ink chamber 21, thus reducing the pressure in the ink chamber 21 to generate a negative pressure. Consequently, ink is fed from the ink tank 30 into the ink chamber 21. Then, ink is fed from the ink tank 30 into the ink chamber 21 until an ink amount sensor (not shown in the drawings) which detects the amount of the ink I in the ink chamber 21 detects that the level of the ink I in the ink chamber 21 is higher than the bottom surface of the ink holding member 24. The ink amount sensor may be, for example, a level sensor including a plurality of electrodes in the ink chamber 21. The level sensor is configured to detect the level of ink by allowing the electrodes to be made electrically continuous or discontinuous by the ink when the surface of the ink reaches a predetermined position. Additionally, the ink amount sensor may be able to detect the amount of the ink I in the ink chamber 21, and is not limited to a configuration that detects the level of ink.

Figure 12B:
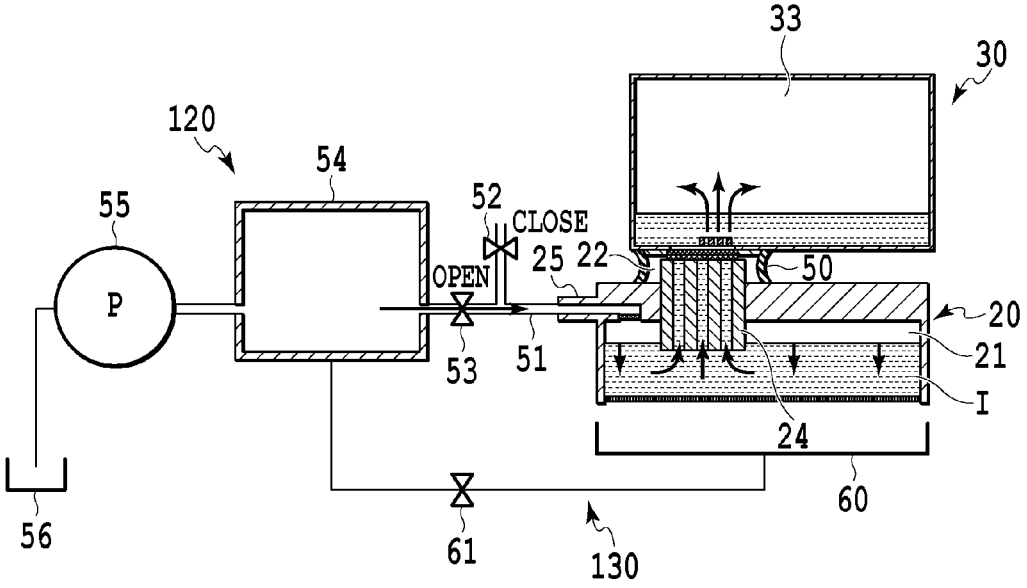
Figure 13A:
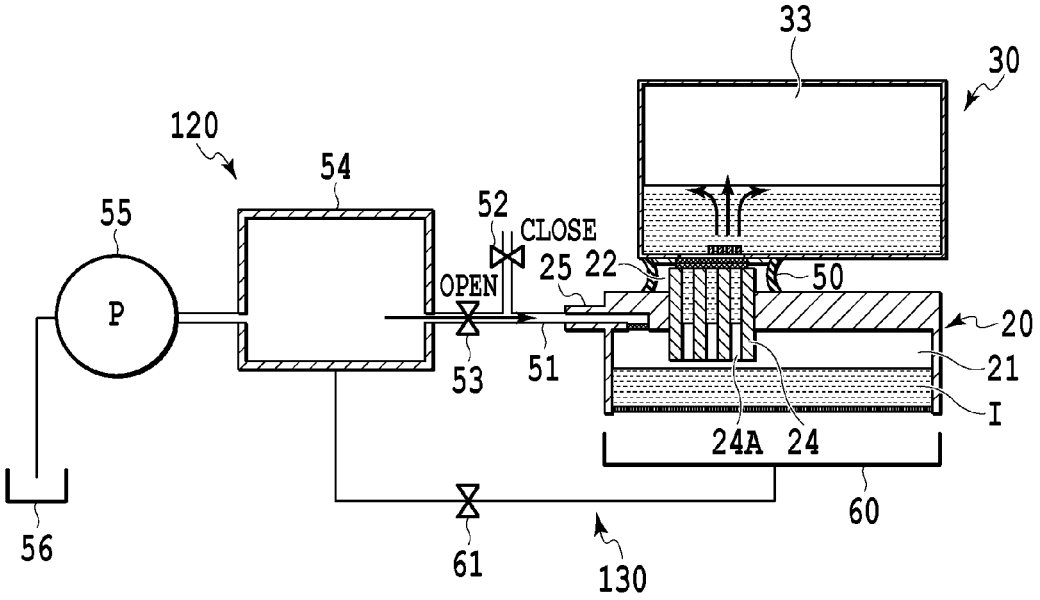
FIG. 13A and FIG. 13B are each a diagram illustrating another part of the example of the ink stirring operation in FIG. 12A and FIG. 12B.
Figure 13B:
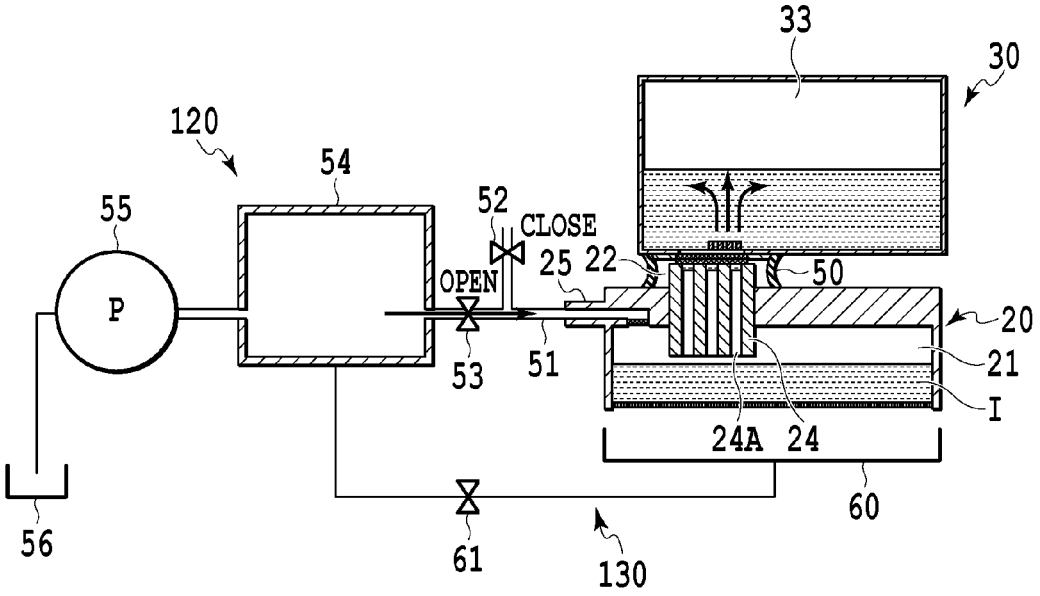

After ink is supplied until the level of the ink I becomes higher than the bottom surface of the ink holding member 24, the pump 55 is rotated in one direction to introduce the gas into the ink chamber 21 to pressurize the inside of the ink chamber 21 as shown in FIG. 12B. Thus, the ink in the ink chamber 21 is fed back to the ink tank 30 through the channels 24A of the ink holding member 24. Subsequently, as shown FIG. 13A, the surface of the ink I in the ink chamber 21 leaves the bottom surface of the ink holding member 24. Then, as shown in FIG. 13B, the ink in the channels 24A of the ink holding member 24 is fed back to the ink tank 30.

As described above, the operation of stirring ink by feeding the ink into and from the ink tank 30 may be repeated a predetermined number of times. Furthermore, such an ink stirring operation enables an increase in the amount of ink fed into and from the ink tank 30 during one stirring operation compared to the operation in FIG. 11A, FIG. 11B, and FIG. 11C in which the ink in the channels 24A of the ink holding member 24 is fed into and from the ink tank 30. As a result, the ink in the ink tank 30 can be more effectively stirred.

Furthermore, when the ink I in the ink chamber 21 is fed back to the ink tank 30 using the pump 55, the inside of the ink chamber 21 may be intermittently pressurized or the pressure in the ink chamber 21 may be changed (increased or reduced).

Moreover, the amount of ink fed into and from the ink tank 30 may be changed in accordance with the length of the period for which the ink tank 30 is left uncontrolled. For example, the amount of ink fed from the ink tank 30 into the ink chamber 21 may be increased consistently with the length of the period for which the ink tank 30 is left uncontrolled. Subsequently, the amount of ink fed back from the ink chamber 21 to the ink tank may be increased. Furthermore, such an ink stirring operation as shown in FIG. 11A, FIG. 11B, and FIG. 11C and such an ink stirring operation as shown in FIG. 12A, FIG. 12B, FIG. 13A, and FIG. 13B may be performed in a switchable manner in accordance with the length of the period for which the ink tank 30 is left uncontrolled. Furthermore, the amount of ink fed into and from the ink tank 30 may be changed not only during one stirring operation but also in accordance with the number of times the stirring operation has been performed.

(At the Start of Ink Supply)

When the ink tank 30 is connected to the print head 20 with no ink present therein, a capping state is established in which the cap 60 is in tight contact with the ejection port formation surface of the print head 20. Then, the cap 60 is internally sucked using the pump 55. Thus, as shown in FIG. 6A, the ink in the ink tank 30 can be supplied to the print head 20. Furthermore, the ink in the ink tank 30 can be supplied to the print head 20 by generating a negative pressure using the pump 55 so that the negative pressure acts in the ink chamber 21 through the buffer chamber 54, the valve 53, and the opening 25. When the cap 60 is used for the suction as in the above-described former case, ink making no contribution to image printing is discharged into the cap 60 as is the case with the suction-based recovery operation. On the other hand, when the suction is carried out through the opening 25 as in the above-described latter case, the ink can be fed into the print head 20 without discharging the ink, making no contribution to image printing, thus suppressing ink consumption.

The amount of ink fed into the print head 20 can be adjusted to an optimum amount using an ink amount sensor (a fluid level sensor for ink; not shown in the drawings) that detects the amount of ink in the ink chamber 21. Ink meniscuses can be formed in the ejection ports 20A by performing the suction-based recovery operation of internally sucking the cap 60 in the capping state using the pump 55.

Furthermore, if the ink in the ink tank 30 connected to the print head 20 is exhausted to reduce the amount of ink in the print head 20, when a new ink tank 30 is connected to the print head 20, the amount of ink in the print head 20 needs to be increased to the optimum value. In this case, the ink in the newly connected ink tank 30 can be fed into the print head 20 by introducing, through the opening 25, a negative pressure generated using the pump 55. Furthermore, when the amount of ink in the print head 20 decreases to the degree that the ink amount sensor fails to detect the amount, the ink in the ink tank 30 can be fed into the print head 20 by introducing a negative pressure into the print head 20 through the opening 25.

As described above, the ink can be fed into the print head 20 without wasteful ink consumption by introducing a negative pressure (a suction force used to reduce the pressure in the print head 20) into the print head 20. During such ink supply, the cap may be in the capping state.

According to the above-described embodiment, the ink holding member 24 is provided on the print head 20 side. However, the ink holding member 24 may be provided on the ink tank 30 side or in a print head installation portion on the printing apparatus side on which the print head 20 is installed. Similarly, the filter member 23 may be provided on the ink tank 30 side or in the print head installation portion on the printing apparatus side on which the print head 20 is installed.

Furthermore, the pressure in the print head 20 may be controlled through the opening 25 in order to reduce a variation in the negative pressure in the print head 20 during a printing operation. When a pressure is applied to the inside of the print head 20, the opening 25 functions as an applied pressure introducing section that allows an applied pressure to be introduced into the print head 20 by introducing the gas and/or liquid through the opening 25. The transfer section 51 functions as an applied pressure supply path that enables the supply of an applied pressure. Additionally, when a suction (pressure reduction) force is applied to the inside of the print head 20, the opening 25 functions as a suction force introducing section that allows a suction force to be introduced into the print head 20 by discharging the gas and/or liquid through the opening 25. The transfer section 51 functions as a suction force supply path that enables the supply of a suction force. The opening 25 may be divided into an introduction section for pressurization and a discharge section for suction. In addition, the applied pressure and the suction force may be a pressure that applies a force to the inside of the print head 20 and a pressure that serves to reduce the pressure in the print head 20, respectively, and are not necessarily limited to a positive pressure and a negative pressure based on the atmospheric pressure.

The present invention can be applied to, besides the full-line printing apparatus, various other printing apparatuses based on the respective printing schemes such as a serial scan printing apparatus that prints an image by moving the print head and performing an operation of conveying the print medium.

Furthermore, the liquid ejection head according to the present invention is not only applicable as an ink jet print head capable of ejecting ink but also widely applicable as a head for ejecting any of various liquids. For example, the liquid ejection head according to the present invention can be used as a head for ejecting any of various process liquids or drugs supplied to a liquid channel. Additionally, the liquid ejection apparatus according to the present invention is not only applicable as an ink jet printing apparatus using an ink jet print head but also widely applicable as an apparatus that applies any of various process liquids or drugs to a processing target member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2013-060517, filed Mar. 22, 2013 and 2014-005229, filed Jan. 15, 2014 which are hereby incorporated by reference herein in their entirety.

What is claimed is:

1. A liquid ejection head capable of ejecting a liquid through an ejection port, the liquid ejection head comprising:

a liquid chamber configured to contain the liquid; and a liquid supply section configured to allow the liquid to be supplied from a liquid container to the liquid chamber, wherein a negative pressure in the liquid chamber is made by a negative pressure generating section of the liquid container, the liquid container being detachably attached to the liquid ejection head, the liquid ejection head comprises an opening configured to communicate with the liquid chamber and to enable at least a gas to flow into the liquid chamber through the opening, and the opening is driven based on a control signal, the control signal for opening the opening being not outputted in a case where the liquid is ejected from the liquid ejection head.

2. The liquid ejection head according to claim 1, wherein the liquid chamber comprises a liquid containing section configured to contain the liquid and a gas containing section configured to contain the gas, and the opening is in communication with the gas containing section.

3. A liquid ejection apparatus configured to use a liquid ejection head configured to enable a liquid to be ejected to apply the liquid ejected from the ejection head to a print medium, wherein the liquid ejection head according to claim 2 is used as the liquid ejection head, and the apparatus comprises a transfer section configured to transfer the gas to the gas containing section through the opening.

4. The liquid ejection head according to claim 1, wherein the liquid chamber comprises a liquid containing section configured to contain the liquid and a gas containing section configured to contain the gas, and the liquid supply section is in communication with the gas containing section, and the negative pressure generating section applies the negative pressure to an inside of the liquid chamber.

5. The liquid ejection head according to claim 1, further comprising a liquid holding member with a channel formed therein to allow the liquid supply section and the liquid chamber to communicate with each other, the liquid holding member enabling the liquid to be held therein, wherein a meniscus of the liquid formed in the channel has a smaller meniscus force than that of a meniscus of the liquid formed in the ejection port.

6. A liquid ejection apparatus configured to use a liquid ejection head configured to enable a liquid to be ejected to apply the liquid ejected from the ejection head to a print medium, wherein the liquid ejection head according to claim 5 is used as the liquid ejection head, and the apparatus comprises a transfer section configured to transfer at least the gas to the liquid chamber through the opening to a degree that a meniscus in the channel is migrated, whereas a meniscus in the ejection port is held.

7. The liquid ejection head according to claim 1, wherein the liquid supply section comprises a filter member, and a meniscus of the liquid formed in the filter member has a larger meniscus force than that of the meniscus of the liquid formed in the ejection port.

8. A liquid ejection apparatus configured to use a liquid ejection head configured to enable a liquid to be ejected to apply the liquid ejected from the ejection head to a print medium, wherein the liquid ejection head according to claim 7 is used as the liquid ejection head, and the apparatus comprises a transfer section configured to transfer at least the gas to the liquid chamber through the opening to a degree that a position of a meniscus in the ejection port migrates, whereas a position of a meniscus in the filter member is maintained.

9. The liquid ejection head according to claim 1, further comprising a detecting section configured to detect the amount of the liquid in the liquid chamber.

10. The liquid ejection head according to claim 9, wherein the detecting section is provided to detect a height of a surface of the liquid in the liquid chamber.

11. A liquid ejection apparatus configured to use a liquid ejection head configured to enable a liquid to be ejected to apply the liquid ejected from the ejection head to a print medium, wherein the liquid ejection head according to claim 1 is used as the liquid ejection head, and the apparatus comprises:

a transfer section configured to transfer at least the gas to the liquid chamber in the liquid ejection head through the opening which communicates with the liquid chamber; and a control unit configured to cause the opening to open and close based on the control signal.

12. The liquid ejection apparatus according to claim 11, wherein the opening is opened to allow the liquid chamber and the outside of the liquid chamber to communicate with each other and then closed based on the control signal.

13. A liquid ejection apparatus configured to use a liquid ejection head configured to enable a liquid to be ejected to apply the liquid ejected from the ejection head to a print medium, wherein the liquid ejection head according to claim 1 is used as the liquid ejection head, and the apparatus comprises:

a transfer section configured to transfer at least the gas to the liquid chamber through the opening of the liquid ejection head; and a liquid supply path configured to enable the liquid with a negative pressure applied thereto to be fed to the liquid supply section.

14. A liquid ejection head capable of ejecting a liquid through an ejection port, the liquid ejection head comprising:

a liquid chamber configured to contain the liquid; and a liquid supply section configured to allow the liquid to be supplied from a liquid container to the liquid chamber, wherein a negative pressure in the liquid chamber is made by a negative pressure generating section of the liquid container, the liquid container being detachably attached to the liquid ejection head, the liquid ejection head comprises an opening configured to communicate with the liquid chamber and to enable at least a gas to flow into the liquid chamber through the opening, and a pressure in the liquid chamber is regulated to at least a first range when the liquid is ejected from the liquid ejection head and a second range different from the first range.

15. The liquid ejection head according to claim 14, wherein the liquid chamber comprises a liquid containing section configured to contain the liquid and a gas containing section configured to contain the gas, and the opening is in communication with the gas containing section.

16. A liquid ejection apparatus configured to use a liquid ejection head configured to enable a liquid to be ejected to apply the liquid ejected from the ejection head to a print medium, wherein the liquid ejection head according to claim 15 is used as the liquid ejection head, and the apparatus comprises a transfer section configured to transfer the gas to the gas containing section through the opening.

17. The liquid ejection head according to claim 14, wherein the liquid chamber comprises a liquid containing section configured to contain the liquid and a gas containing section configured to contain the gas, and the liquid supply section is in communication with the gas containing section, and the negative pressure generating section applies the negative pressure to an inside of the liquid chamber.

18. The liquid ejection head according to claim 14, further comprising a liquid holding member with a channel formed therein to allow the liquid supply section and the liquid chamber to communicate with each other, the liquid holding member enabling the liquid to be held therein, wherein a meniscus of the liquid formed in the channel has a smaller meniscus force than that of a meniscus of the liquid formed in the ejection port.

19. A liquid ejection apparatus configured to use a liquid ejection head configured to enable a liquid to be ejected to apply the liquid ejected from the ejection head to a print medium, wherein the liquid ejection head according to claim 18 is used as the liquid ejection head, and the apparatus comprises a transfer section configured to transfer at least the gas to the liquid chamber through the opening to a degree that a meniscus in the channel is migrated, whereas a meniscus in the ejection port is held.

20. The liquid ejection head according to claim 14, wherein the liquid supply section comprises a filter member, and a meniscus of the liquid formed in the filter member has a larger meniscus force than that of the meniscus of the liquid formed in the ejection port.

21. A liquid ejection apparatus configured to use a liquid ejection head configured to enable a liquid to be ejected to apply the liquid ejected from the ejection head to a print medium, wherein the liquid ejection head according to claim 20 is used as the liquid ejection head, and the apparatus comprises a transfer section configured to transfer at least the gas to the liquid chamber through the opening to a degree that a position of a meniscus in the ejection port migrates, whereas a position of a meniscus in the filter member is maintained.

22. The liquid ejection head according to claim 14, further comprising a detecting section configured to detect the amount of the liquid in the liquid chamber.

23. The liquid ejection head according to claim 22, wherein the detecting section is provided to detect a height of a surface of the liquid in the liquid chamber.

24. A liquid ejection apparatus configured to use a liquid ejection head configured to enable a liquid to be ejected to apply the liquid ejected from the ejection head to a print medium, wherein the liquid ejection head according to claim 14 is used as the liquid ejection head, and the apparatus comprises:

a transfer section configured to transfer at least the gas to the opening in the liquid ejection head which communicates with the liquid chamber; and a control unit configured to cause the opening to open and close based on the control signal.

25. The liquid ejection apparatus according to claim 24, wherein the opening is opened to allow the liquid chamber and the outside of the liquid chamber to communicate with each other and then closed based on control signal.

26. A liquid ejection apparatus configured to use a liquid ejection head configured to enable a liquid to be ejected to apply the liquid ejected from the ejection head to a print medium, wherein the liquid ejection head according to claim 14 is used as the liquid ejection head, and the apparatus comprises:

a transfer section configured to transfer at least the gas to the liquid chamber through the opening of the liquid ejection head; and a liquid supply path configured to enable the liquid with a negative pressure applied thereto to be fed to the liquid supply section.

* * * * *